US005924885A

United States Patent [19]

Pacher

[11] Patent Number: 5,924,885

[45] Date of Patent: Jul. 20, 1999

[54] AXIAL CONNECTION WITH POSITION ASSURANCE SYSTEM

[75] Inventor: Franz Pacher, Eckental, Germany

[73] Assignee: Framatome Connectors Interlock, Inc., Westland, Mich.

[21] Appl. No.: 08/891,291

[22] Filed: Jul. 10, 1997

[51] Int. Cl.[6] ..... H01R 13/627

[52] U.S. Cl. ..... 439/352

[58] Field of Search ..... 439/350, 352, 439/353, 357, 188, 499

[56] References Cited

U.S. PATENT DOCUMENTS 5,591,041 1/1997 Cecil, Jr. et al. ..... 439/352
5,647,757 7/1997 Chrysostomou ..... 439/352
5,688,141 11/1997 Dullin ..... 439/352
5,779,495 7/1998 Dechelette et al. ..... 439/352

*Primary Examiner*—Hien Vu
*Attorney, Agent, or Firm*—Pollock, Vande Sande & Amermick

[57] ABSTRACT

An axial airbag connector with a connector assurance slide including a plug connector, a bottom cover attached to the plug connector, and a sliding cover with forwardly extending secondary locking arms. The sliding cover can be locked in either a forward or a rear position. When the sliding cover is in its forward position, the secondary locking arms force plug locking arms at the front of the plug connector outwardly so as to engage the plug connector in its mating socket. A displacement limiter is used to limit the range of movement of the sliding cover between its forward and rear positions.

18 Claims, 4 Drawing Sheets

AXIAL CONNECTION WITH POSITION ASSURANCE SYSTEM

BACKGROUND OF THE INVENTION

1. Field of the Invention

The present invention relates to electrical connectors for vehicle occupant inflatable restraint systems, generally known as airbag systems. More particularly, the invention relates to a two-position axial airbag connector with a connector position assurance slide.

2. Description of Related Art

Use of airbag systems in motor vehicles has become virtually universal in recent years and is mandatory in many jurisdictions. Such systems normally include an airbag assembly mounted in a hidden compartment beneath the dashboard and an electrical or electronic control system for activating the assembly upon occurrence of a crash. The airbag assembly is generally connected to the control system by a wiring harness provided with a plug with socket contacts and a socket that receives pin contacts of the initiator.

A connector system of this type is shown, for example, in EP 0 591 947, in which the system is associated with an interlock including a locking element that is inserted into the connection to prevent separation of a pair of male connector elements carried by a first component from a pair of female connector elements carried by a second component and releasably mated therewith. A shorting element is associated with the first component and includes a pair of contact elements each biased into electrical contact with one of the pair of first connector elements for producing a short therebetween. The second component has a body comprising a portion contoured to enter between the pairs of connector elements for disconnecting the short upon mating of the first and second components, which are mechanically latched together. The locking element prevents release of the latch and hence separation of the two components while in the locked position.

U.S. Pat. No. 5,435,742 shows an electrical connector position assurance system (CPA) in which one of two mating connectors includes a projection which is at a first location when the connectors are fully mated and at a second location when they are less than fully mated. The projection blocks movement of a CPA from its first to its second position when the projection is in its second location. A latch holds the connectors in mated condition when the CPA is in its second position.

SUMMARY OF THE INVENTION

The invention comprises an axial airbag connector with a position assurance slide. The connector has a sliding cover which is provided with forwardly extending secondary locking arms. The sliding cover can be locked in a rear and a forward position. When the sliding cover is in its forward position, the secondary locking arms cooperate with locking arms on the connector to secure the axial airbag connector in a mated position with the ignitor socket. Displacement limiters for the sliding cover extend from a bottom cover. The displacement limiters interact with the sliding cover to limit the sliding cover's range of movement. Contact locking fingers are provided on the bottom cover.

The connector is assembled as follows. First, the connection wires are inserted in longitudinally extending channels provided in the connector. The sliding cover is then mounted in its rear position on retention elements, and is then slid into its front position. The bottom cover is then assembled by first inserting the contact locking fingers for maintaining the contacts in position, and then engaging locking lugs on the connector with locking clips on the bottom cover by rotating the bottom cover. The locking clips are provided with projections which limit displacement of the sliding cover between its forward and rear positions.

BRIEF DESCRIPTION OF THE DRAWINGS

In order that the invention may be more clearly understood, it will now be described with reference to the accompanying drawings, in which an embodiment of the invention is shown for purposes of illustration.

DESCRIPTION OF THE PREFERRED EMBODIMENT

Figure 1:
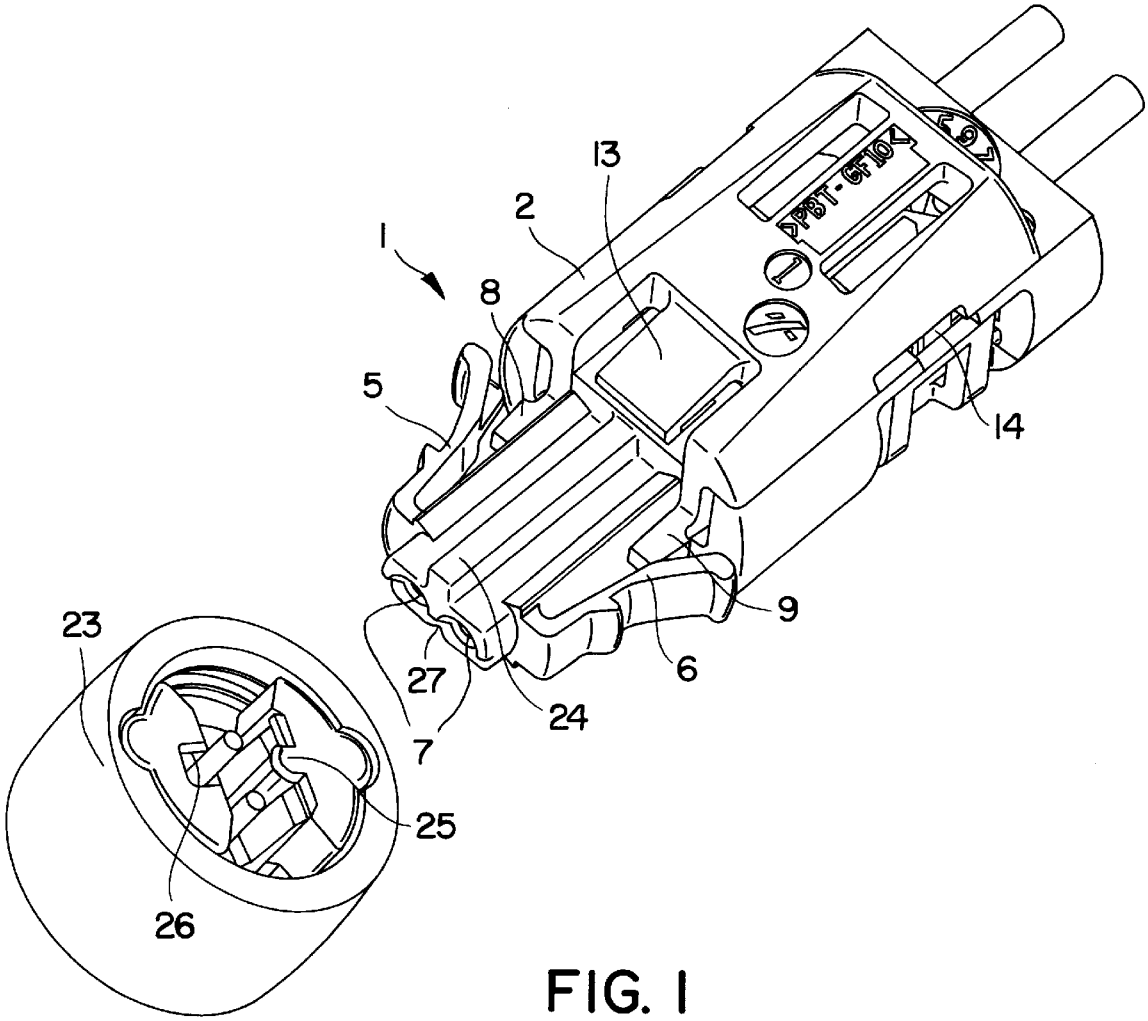
FIG. 1 is a perspective view of the connector and airbag initiator in unassembled position.

FIG. 1 shows an assembled axial airbag connector 1 ready to be mated with the ignitor socket 23. Connection wires 21 enter the rear of the axial connector and are connected to the airbag initiator through contact reception cavities 7. Keying ribs 24, 25 are provided on the connector 1 and the ignitor socket 23, respectively. Corresponding keying recesses 26, 27 are provided to ensure a proper alignment when the two components are mated. Before the connector 1 is inserted into the ignitor socket 23, the sliding cover 2 is in its rear position. Simultaneously with insertion of the connector 1 into the ignition socket 23, the sliding cover 2 is moved into its forward position. In this position, secondary locking arms 8, 9 force plug locking arms 5, 6 outward to secure the connector 1 inside the ignitor socket 23. A retainer 28 is provided in the ignitor socket 23 on either side of the connector 1 in order to prevent rotation of the connector 1.

Figure 2:
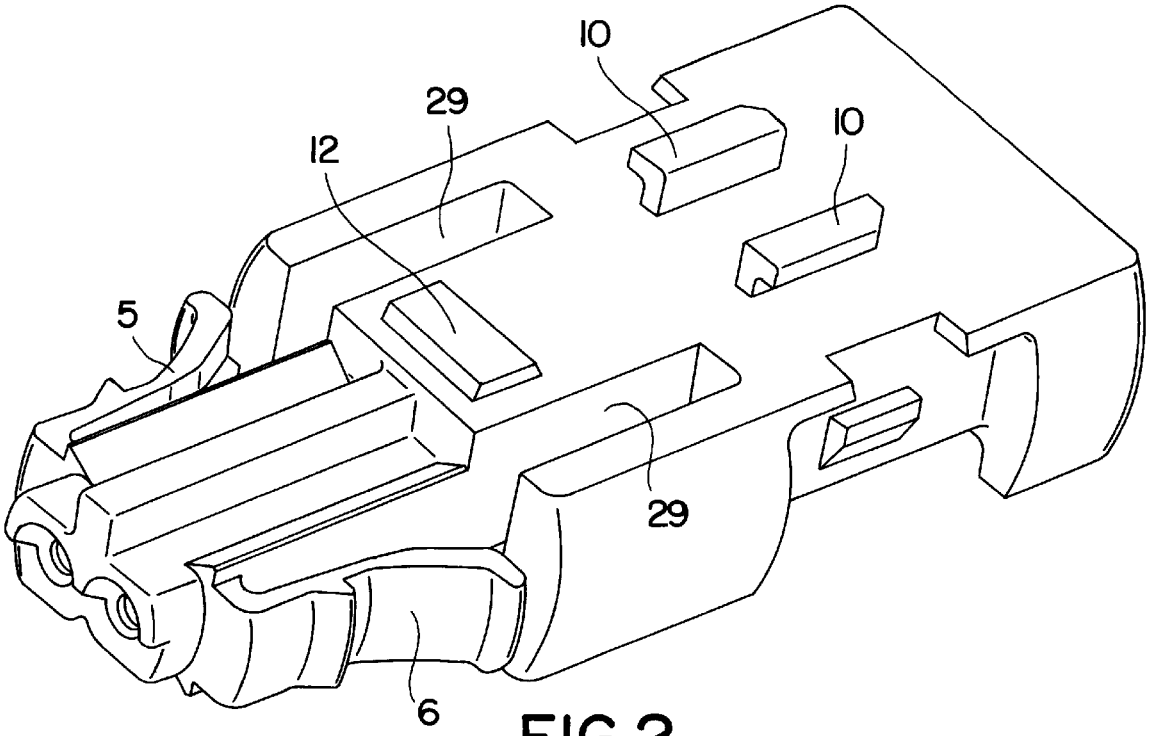
FIG. 2 is a perspective view of the connector prior to assembly of the sliding cover.
Figure 7:
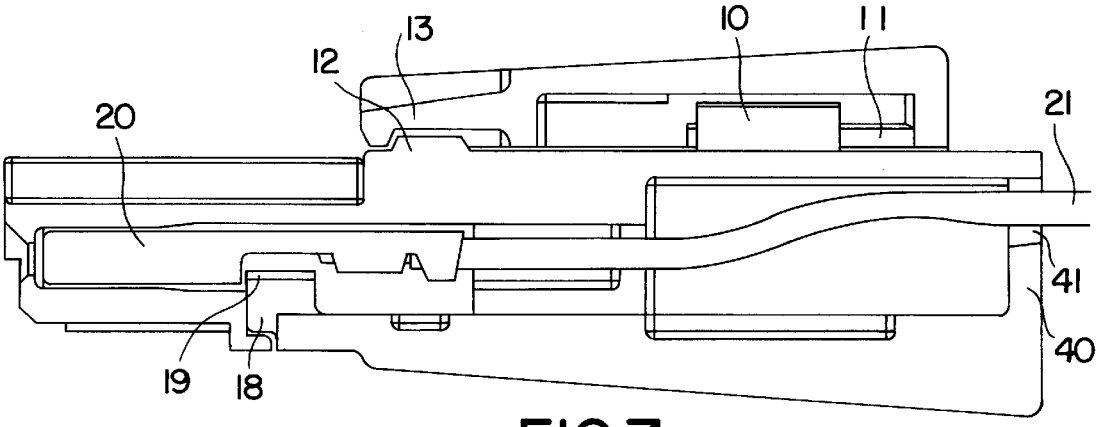
FIG. 7 is a side view, partly in section, of the assembly connector.

As can be seen in FIG. 2, the connector body has a generally rectangular shape. The plug locking arms 5, 6 are provided on both sides of the portion of the connector body which is inserted into the ignitor socket 23. A stop 12 is provided on the top of the connector body for locking the sliding cover 2 in either its forward or rear position. As shown in FIG. 7, stop 12 is engaged by a resilient finger 13 which is located on top of the connector body. The resilient finger 13 exerts a force on stop 12 to lock the sliding cover 2 in a forward or a rear position. The resilient finger 13 will give under sufficient force so that the sliding cover 2 may be moved to another position. A pair of generally L-shaped retention elements 10 hold the sliding cover in place on top of the connector body.

Figure 3:
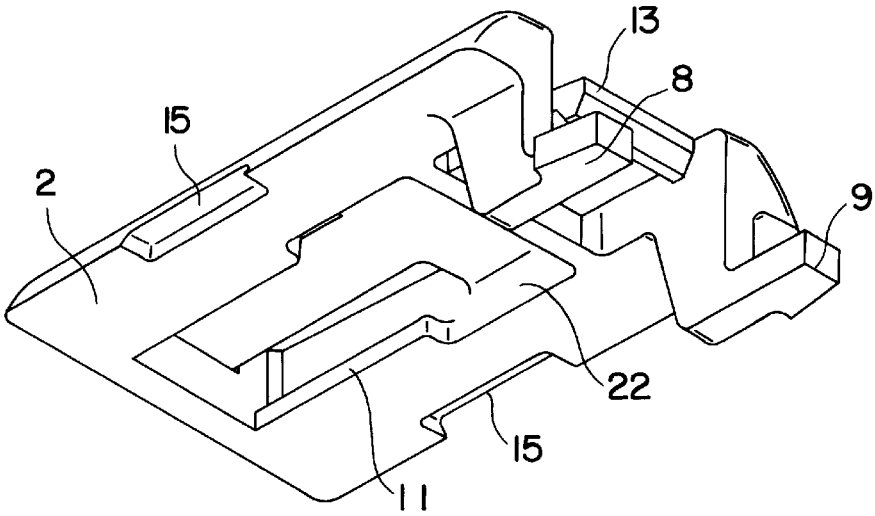
FIG. 3 is a bottom perspective view of the sliding cover.
Figure 5:
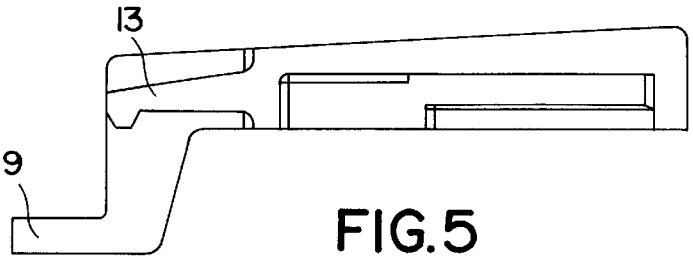
FIG. 5 is a side view, partly in section, showing the relationship of the secondary locking arms extending from the sliding cover and the resilient finger on the connector body.

The sliding cover 2, best shown in FIGS. 3 and 5, has a rectangular shape corresponding to that of the connector body, and is provided with an enlarged recess 22 for insertion of the retaining elements 10. Retaining rails 11 extend longitudinally from the recess 22. The sliding cover 2 is placed on top of the connector 1 and is slid forward so that the retaining rails 11 of the sliding cover 2 engage the retaining elements 10 of the connector body to hold the sliding cover 12 in place. The sliding cover 2 is thus allowed to slide along the top of the connector body. The secondary locking arms 8, 9 extend forward from the sliding cover 2 and are inserted into grooves 29 provided on the connector body. The resilient finger 13 is provided in between the secondary locking arms 8, 9. Also on either side of the sliding cover 2 a window 15 is provided for receiving a displacement limiter 14 which extends from the bottom cover 3. When the sliding cover is in its forward position, the secondary locking arms 8, 9 are moved forward and force the plug locking arms 5, 6 outwardly of the connector body, so as to retain the connector in the ignitor socket 23.

Figure 4:
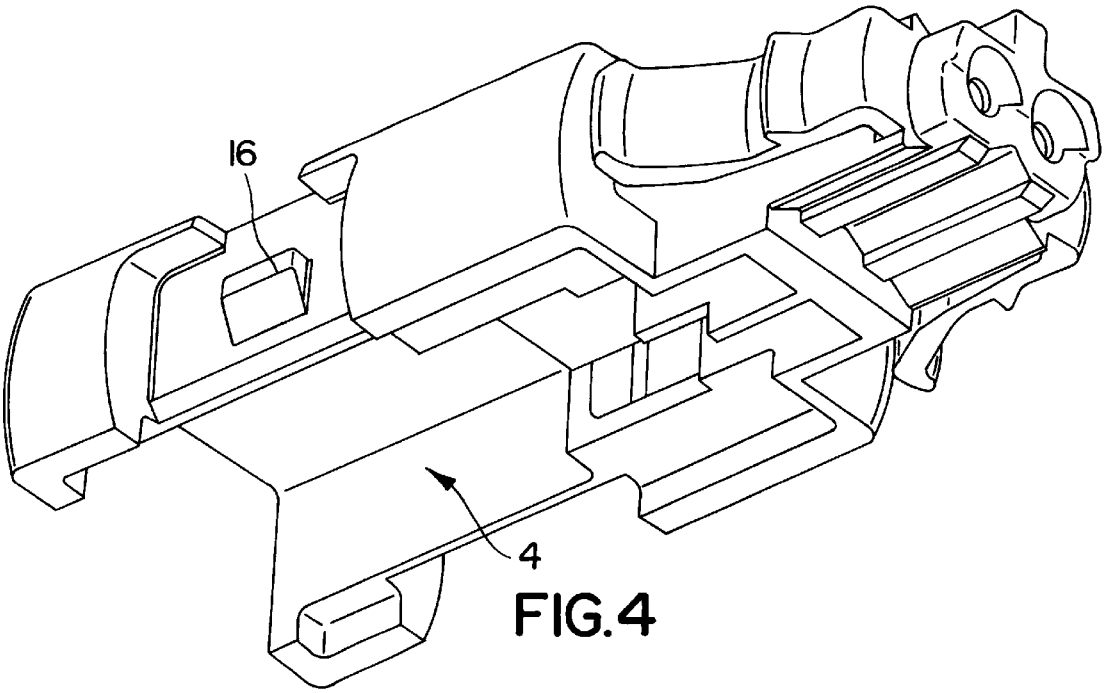
FIG. 4 is a bottom perspective view of the connector prior to assembly of the bottom cover.
Figure 4A:
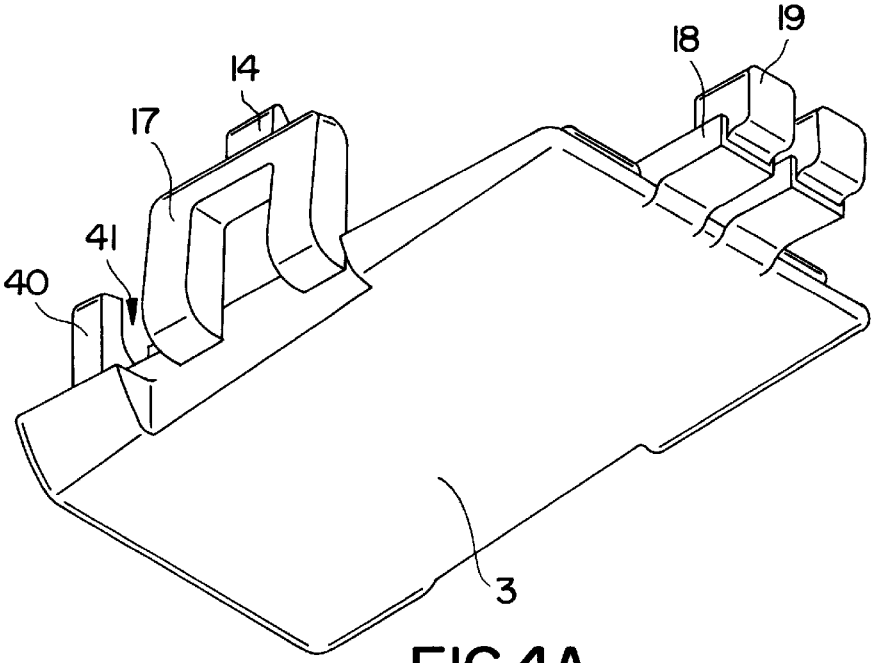
FIG. 4*a* is a bottom perspective of the bottom cover.
Figure 6:
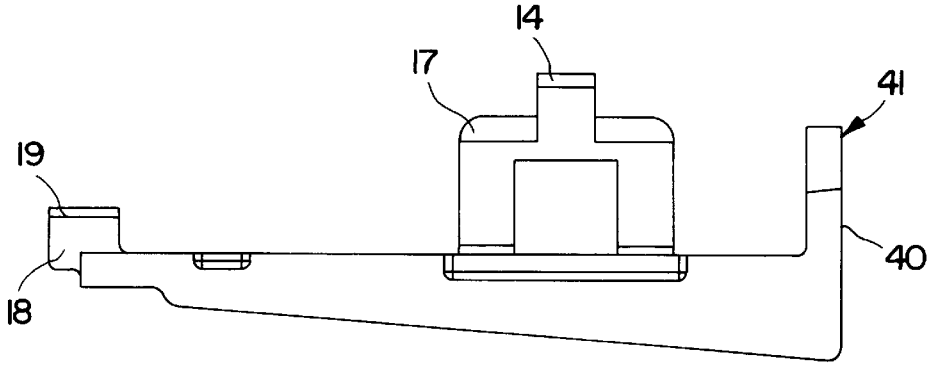
FIG. 6 is a side view of the bottom cover including its locking clip and sliding cover displacement limiter.

FIGS. 4 and 4*a* show the connector body and the bottom cover 3. Bottom cover locking lugs 16 protruding from both sides of the connector body interact with the bottom cover locking clips 17 provided on both sides of the bottom cover 3 so as to secure the bottom cover 3 to the connector body when bottom cover locking clips 17 slide over the bottom cover locking lugs 16 and snap in place. A displacement limiter 14 projects from the top of each bottom cover locking clip 17 and extends into the window area 15 of the sliding cover 2 when the bottom cover 3 is attached to the connector, best shown in FIGS. 6 and 7. The displacement limiter 14 contacts an end of the window 15 when the limit of the range of movement of the sliding cover 2 between the forward and rear positions is reached. The bottom cover 3 is further provided with a front locking lug 18, which helps to hold the bottom cover 3 in place, and contact locking fingers 19 which fit into recesses provided in the connector body. When the bottom cover 3 is locked in place, the contact locking fingers 19 retain the contact inside the connector body so that when the connector is mated with the ignitor socket 23, a closed circuit between the two is created.

What is claimed is:

1. An axial airbag connector with a connector assurance slide comprising:

(a) a plug connector;

(b) a sliding cover, mounted for longitudinal sliding movement along a top of said plug connector;

(c) a bottom cover attached to a bottom of said plug connector by latching means;

(d) means for locking said sliding cover in a forward and a rear position; and (e) a displacement limiter which cooperates with said sliding cover to limit a range of movement of said sliding cover between said forward and rear positions;

wherein said displacement limiter further comprises at least one projection extending from said bottom cover into a recess of said sliding cover, said projection coming into contact with an end of said recess when said sliding cover reaches predetermined limits of said range of movement.

2. The axial airbag connector according to claim 1, wherein said means for locking further comprises a resilient finger on said sliding cover which cooperates with a stop on said connector to assure that said sliding cover is retained in said forward and said rear positions, respectively.

3. The axial airbag connector according to claim 1, wherein said plug connector further comprises plug locking arms arranged on both sides of said plug connector, said plug locking arms being adapted to fit into an ignitor socket with which the axial airbag connector is to be mated.

4. The axial airbag connector according to claim 1, further comprising secondary locking arms extending forwardly from said sliding cover, said arms sliding in grooves in said plug connector whereby when said sliding cover is slid into said forward position, said secondary locking arms force said plug locking arms outwardly to secure engagement of said axial airbag connector with said ignitor socket.

5. The axial airbag connector according to claim 1, further comprising contact locking fingers which are attached to said bottom cover and which are adapted to fit into recesses in said plug connector and to retain contacts in place inside said plug connector.

6. The axial airbag connector according to claim 1, further comprising retention elements located on top of said connector and cooperating with retention rails on said sliding cover to allow said sliding cover to slide longitudinally along said connector.

7. The axial airbag connector according to claim 1, wherein said latching means comprises loops extending on both longitudinal sides of said bottom cover, said loops engaging latches projecting from both longitudinal sides of said plug connector.

8. An axial airbag connector with a connector assurance slide comprising:

(a) a plug connector;

(b) a sliding cover, mounted for longitudinal sliding movement along a top of said plug connector;

(c) a bottom cover attached to a bottom of said plug connector by latching means;

(d) means for locking said sliding cover in a forward and a rear position;

(e) a displacement limiter which cooperates with said sliding cover to limit a range of movement of said sliding cover between said forward and rear positions; and (f) locking fingers which are attached to said bottom cover and which are adapted to fit into recesses in said plug connector and to retain contacts in place inside said plug connector.

9. The axial airbag connector according to claim 8, wherein said bottom cover comprises a rear wall provided with passageways for connection wires and retaining said connection wires in position when said bottom cover is snapped on a plug.

10. A plug connector having a bottom cover attached to a bottom of said connector by latching means, said bottom cover comprising at least one front locking lug and at least one contact locking finger which fits into a recess provided in the connector body, said contact locking finger retaining a corresponding contact in a contact reception cavity of a plug housing.

11. The plug connector according to claim 10, wherein said bottom cover comprises a rear wall provided with passageways for connection wires and retaining said connection wires in position when said bottom cover is snapped on a plug.

12. The plug connector according to claim 11, wherein said latching means comprises loops extending on both longitudinal sides of said bottom cover, said loops engaging latches projecting from both longitudinal sides of said plug connector.

13. The plug connector according to claim 10, further comprising a connector security slide constituted by a sliding cover mounted for longitudinal movement along a top of said plug connector and comprising a displacement limiter which cooperates with said sliding cover to limit said longitudinal movement of said sliding cover in both directions.

14. The plug connector according to claim 13, wherein said displacement limiter comprises at least one projection extending from said bottom cover into a recess of said sliding cover, said projection coming into contact with an end of said recess when said sliding cover reaches predetermined limits of said range of movement.

15. The plug connector according to claim 9, including means for locking said sliding cover in a forward and a rear position, said locking means comprising a resilient finger on said sliding cover which cooperates with a stop on said connector to assure that said sliding cover is retained in said forward and said rear positions, respectively.

16. The plug connector according to claim 9, comprising locking arms arranged on both sides of said plug connector, said plug locking arms being adapted to fit into an igniter socket with which the axial airbag connector is to be mated.

17. The plug connector according to claim 16, further comprising secondary locking arms extending forwardly from said sliding cover, said arms sliding in grooves in said plug connector whereby, when said sliding cover is slid into said forward position, said secondary locking arms force said plug locking arms outwardly to secure engagement of said axial airbag connector with said igniter socket.

18. The plug connector according to claim 9, further comprising retention elements located on top of said connector and cooperating with retention rails on said sliding cover to allow said sliding cover to slide longitudinally along said connector.

* * * * *